United States Patent [19]

Brusini

[11] Patent Number: 4,989,526

[45] Date of Patent: Feb. 5, 1991

[54] EQUIPMENT FOR THE AUTOMATIC SEWING OF SHOULDER PADS FOR CLOTHING

[75] Inventor: Bruno Brusini, Torino, Italy

[73] Assignee: ST Automations S.r.l., Torino, Italy

[21] Appl. No.: 375,651

[22] Filed: Jul. 5, 1989

[30] Foreign Application Priority Data

Jul. 5, 1988 [IT] Italy ..... 67634 A/88

[51] Int. Cl.[5] ..... D05B 21/00; D05B 25/00

[52] U.S. Cl. ..... 112/121.12; 112/121.14; 112/155

[58] Field of Search ..... 112/2, 118, 119, 121.12, 112/121.14, 121.28, 308, 311, 115

[56] References Cited

U.S. PATENT DOCUMENTS

| | | | |
|---|---|---|---|
| 1,394,244 | 10/1921 | Adair et al. | 112/2 |
| 2,318,686 | 5/1943 | Hathaway | 112/21.14 |
| 2,393,786 | 1/1946 | Lenartowicz et al. | 112/121.14 |
| 2,771,045 | 11/1956 | Cash, Jr. | 112/121.14 |
| 2,855,877 | 10/1958 | Whitehead | 112/121.14 |
| 4,503,788 | 3/1985 | Giannuzzi et al. | 112/121.14 X |
| 4,788,921 | 12/1988 | Codos | 112/118 |

*Primary Examiner*—Werner H. Schroeder
*Assistant Examiner*—Paul C. Lewis
*Attorney, Agent, or Firm*—Sughrue, Mion, Zinn, Macpeak & Seas

[57] ABSTRACT

Equipment for the automatic sewing of shoulder pads for clothing includes a support structure, a pair of sewing machines (18) which are slidable along the same line on the structure and have parallel vertical needles (18*a*), and an oscillator device (64) adapted for connection to a tool for clamping the pieces of cloth and the pad of the shoulder pad and capable of reciprocating rotation about an axis parallel to the line along which the sewing machines (18) slide, so as to effect the automatic sewing of the shoulder pad along a predetermined outline.

7 Claims, 9 Drawing Sheets

EQUIPMENT FOR THE AUTOMATIC SEWING OF SHOULDER PADS FOR CLOTHING

BACKGROUND OF THE INVENTION

The present invention relates to equipment for the automatic sewing of shoulder pads for clothing.

Shoulder pads for clothing are currently produced manually by operators equipped with conventional sewing machines. This results in long production cycles for the shoulder pads, high production costs, and inconsistent quality of the shoulder pads produced.

SUMMARY OF THE INVENTION

The object of the present invention is to provide equipment of the type specified at the beginning of the description, which does not have the above disadvantages and enables the shoulder pads to be produced automatically at a fast production rate and to a high standard of quality.

According to the invention, this object is achieved by virtue of the fact that the equipment includes a support structure, at least one sewing machine supported for sliding on the structure, an oscillator device adapted for connection to a tool which clamps together two, facing, shaped pieces of cloth with an interposed pad for forming the shoulder pads, the oscillator device being supported by the structure for rotation about an axis parallel to the line along which the sewing machine slides, means for driving the sewing machine in reciprocating rectilinear motion, and means associated with the oscillator device for causing the reciprocating rotation of the tool in synchronism with the movement of the sewing machine in order to provide for the sewing together of the pieces of cloth and the pad along a predetermined outline.

By virtue of these characteristics, the manual aspect of the production of the shoulder pads is reduced simply to the loading of the pieces of cloth and the pad into the appropriate tool, the loading of the tools into the equipment and their removal therefrom being achievable, to advantage, by automatic manipulators. Moreover, the loading and unloading of the tool are operations which can easily be automated, thus completely eliminating any manual operation.

BRIEF DESCRIPTION OF THE DRAWINGS

Further characteristics and advantages of the present invention will become clear from the detailed description which follows with reference to the appended drawings, provided by way of non-limiting example, in which:

FIG. 4 is a section taken on the line IV—IV of FIG. 3, FIG. 5 is a perspective view of a portion of the equipment in an operative configuration, FIG. 6 is a partially-sectioned side view of the equipment of FIG. 1, FIG. 7 is a partially-sectioned view taken on the arrow VII of FIG. 6, FIG. 8 is an exploded perspective view of a detail of FIG. 5, and FIG. 9 is a section of a detail of FIG. 8 in an assembled configuration.

DETAILED DESCRIPTION OF THE INVENTION

Figure 1:
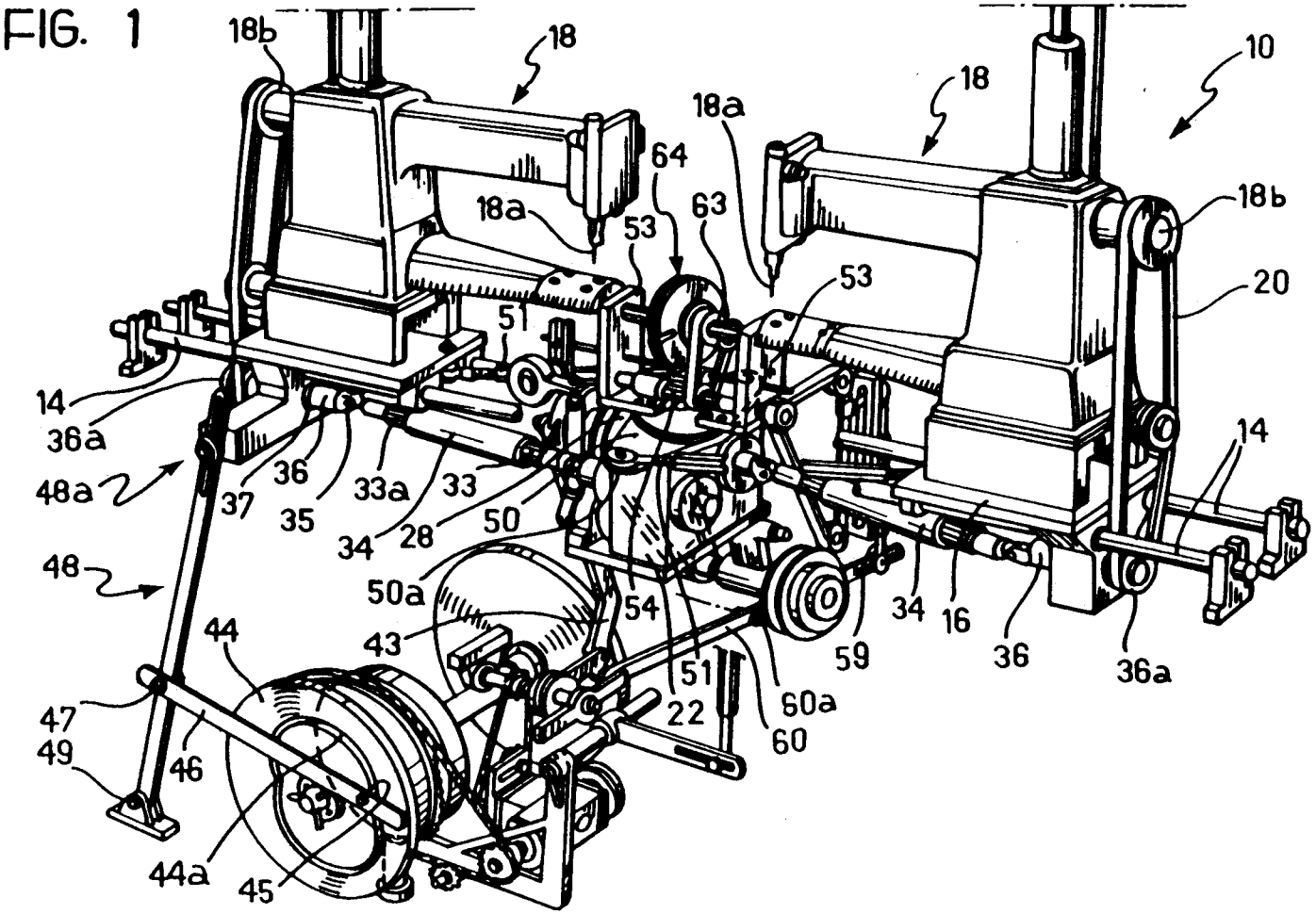
FIG. 1 is a schematic perspective view of equipment according to the invention.
Figure 2:
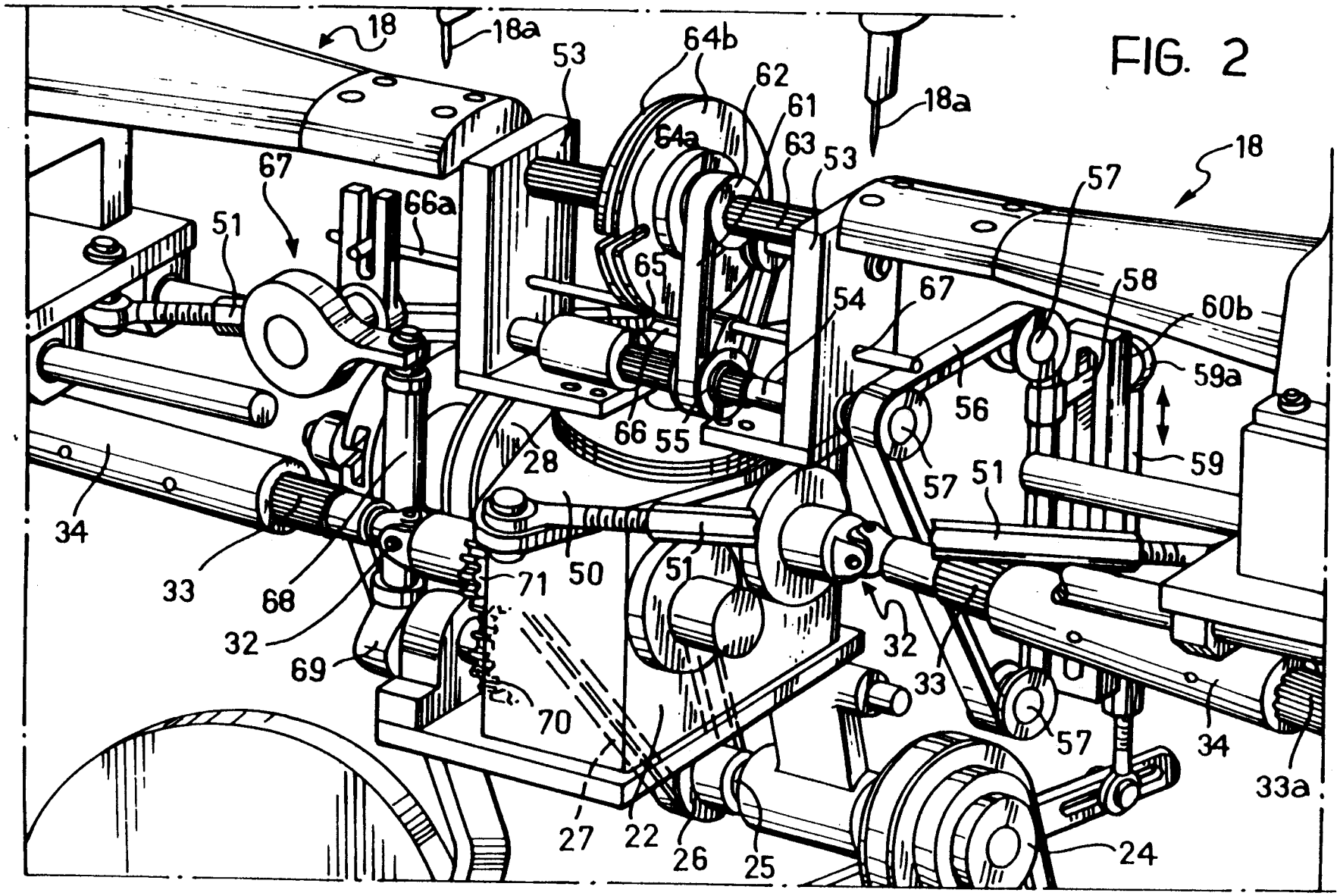
FIG. 2 is a perspective view of a detail of FIG. 1 on an enlarged scale.

With reference to the drawings equipment for the automatic production of shoulder pads for clothing is generally indicated 10. The equipment 10 has a support structure 12 carrying parallel horizontal guide bars 14. The bases 16 of two sewing machines 18 of known type are mounted for sliding on the bars 14 and have parallel vertical needles **18*a* which are operated by pulleys 18*b* driven by transmission belts 20**.

Figure 3:
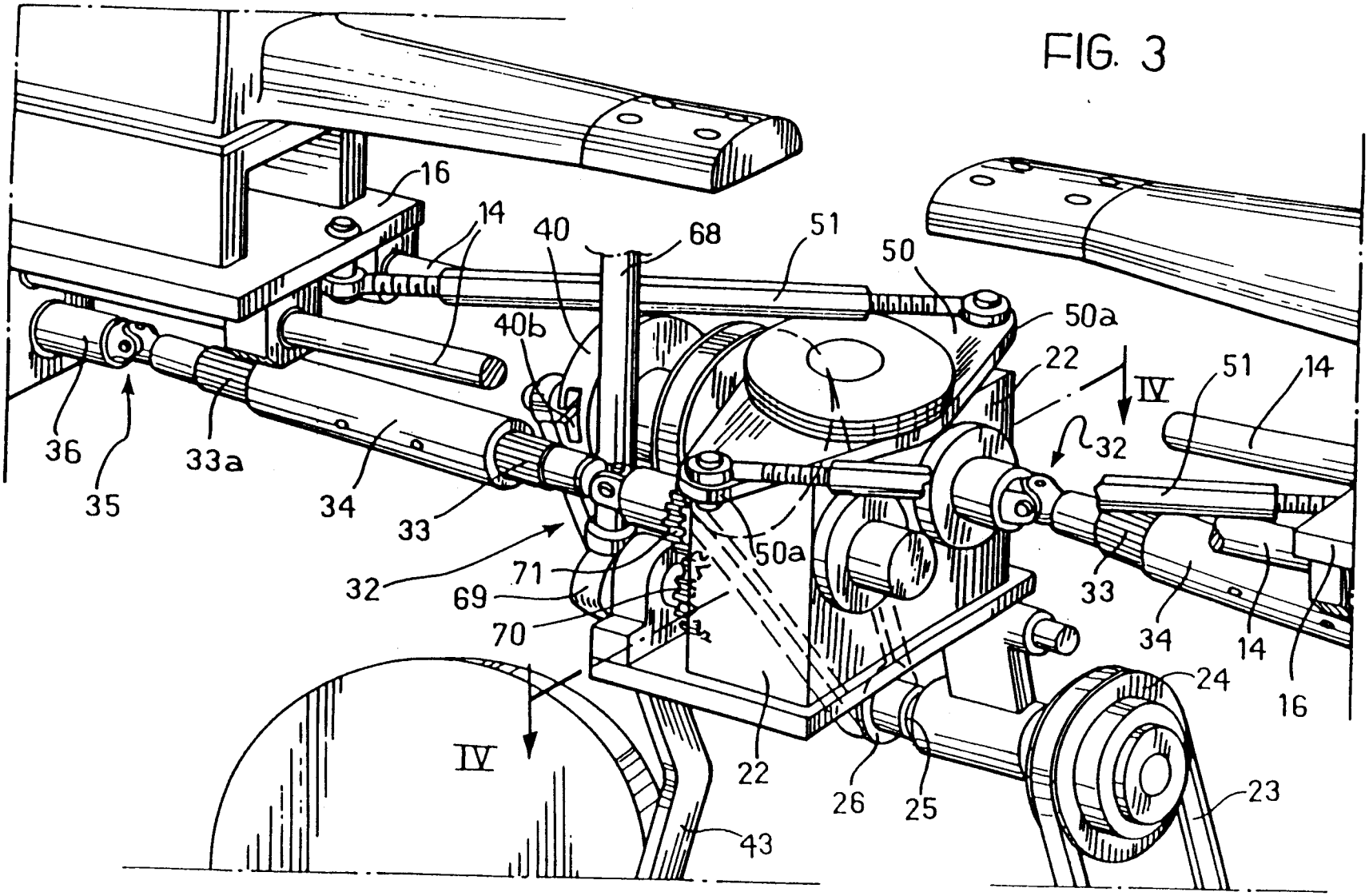
FIG. 3 is a detail of FIG. 2 which shows the connection between the two sewing machines.

The structure 12 of the equipment supports a transmission box 22 (FIGS. 3 and 4) to which power is supplied by means of a toothed belt 23, a pulley 24, a transmission shaft 25, a driving pulley 26, a further toothed belt 27, and a driven pulley 28. A first horizontal shaft 29 keyed to the latter pulley is rotatable relative to the box 2Z with the interposition of rolling bearings 30 and is in turn keyed to a gear 31 which is meshed with an identical gear **31*a* keyed to a second shaft 29*a* mounted for rotation relative to the box 22 with the interposition of rolling bearings 30*a*. Splined transmission shafts 33 are keyed to the first and second shafts 29 and 29*a* with the interposition of first universal joints 32 and are adapted to transmit the drive to auxiliary splined shafts 33*a* with the interposition of splined sleeves 34 which are adapted to enable the rotary motion also to be transmitted when the splined shafts 33*a* are in reciprocating motion towards and away from each other. With the interposition of second universal joints 35, the auxiliary splined shafts 33*a* rotate auxiliary shafts 36 which are mounted for rotation in holes 37 in the supports 16 of the sewing machines 18 and are adapted to drive, by means of pulleys 36*a*, the belts 20 which operate the sewing machines. A disc 40 is keyed to one end 29*b* of the first shaft 29 of the transmission box 22 and is provided with a radial prismatic guide 40*b* in which the end 41*b* of a crank pin 41 is slidably mounted for adjustment the crank pin 41 being connected, with the interposition of rolling bearings 42, to a connecting rod 43** whose function will become clear from the following description.

The reciprocating motion of the sewing machines 18 along the guide bars 14 is achieved by means of a disc 44 which is rotated by the main motor of the equipment (not shown) and carries an annular cam groove **44*a* for cooperating with a follower 45 connected to a control arm 46. The latter is articulated at 47 to a lever 48 which is pivoted at 49 on the structure of the equipment and is provided with a link-like end 48*a* for causing the sliding of one of the two sewing machines 18. The movement of the latter is transmitted to the other sewing machine 18, which moves along the same line as the first machine but in the opposite direction, by means of a rotary member 50 which is articulated to the transmission box 22 about a vertical axis and has its opposite end 50*a* articulated to adjustable rods 51. Between the two sewing machines 1B, the structure 12 supports a pair of L-shaped brackets 53 which face each other and rotatably support the ends of a first splined shaft 54 to which a first slidable pulley 55 is keyed. The splined shaft 54 is rotated by means of a toothed belt 56 which is looped around pulleys 57 and is connected at 58 to the end 59*a* of a vertical operating rod 59. The latter is articulated to a horizontal lever 60 which is articulated centrally at 60***a* and is oscillated by means of the connecting rod 43. The movement of the latter causes, through the lever 60, a vertical reciprocating movement of the operating rod 59 which, in cooperation with a fixed guide 60*b*, causes the reciprocating motion of the belt 56 and this causes a reciprocating rotary motion of the splined shaft 54. By means of a belt 61, the first slidable pulley 55 drives a second pulley 62 which is keyed slidably to a second splined shaft 63 whose ends are supported for rotation by the brackets 53. A circular disc-shaped support 64 is also keyed to the second pulley 62 and has a radial notch 64*a* for the mounting of a tool 100, shown in detail in FIGS. 8 and 9.

The tool 100 comprises an upper element 112 and a lower element 114 formed by metal plates curved about a longitudinal axis X—X. The elements 112 and 114 have respective apertures 112*a* and 114*a* which substantially correspond in shape to, but are smaller than the semi-finished product S.

The latter is defined for example by two precut pieces T of unwoven cloth between which a pad I of wadding is interposed.

The lower positioning element 114 has a curved convex bridge 118 which connects the edges 116 of the aperture 114*a* and is arranged transverse the longitudinal axis X—X. A flat element 118*a* is also associated with the bridge 118 and is adapted to be interposed between a pair of slightly-spaced-apart discs 64*b* which constitute the disc-shaped support 64.

Around the edge 116 and in correspondence with the bridge 118, the lower element 114 has a surface portion 120 with a high coefficient of friction. Similarly, the upper element 112 has an annular surface portion 122 with a high coefficient of friction. To advantage, the surface portions 120 and 122 may, for example, be covered with suitable antislip paint.

Vertical coupling pins 124 are fixed to ends 114*b* of the lower elements 114 in correspondence with coupling bushes 126 fixed at ends 112*b* of the upper element 112. Each bush 126 has a longitudinal slot 126*a* for enabling cooperation between a cam element 128 articulated at 130 to the bush itself and the lateral surfaces of the coupling pins 124. The cam elements 128 are operated manually by means of levers 128*a* but may to advantage be operated automatically.

A pin 65 of a slider 66 which is slidable in holes in the brackets 53, parallel to the line along which the sewing machines 18 slide, is interposed betWeen the discs 64*b*. The slider 66 has an end 66*a* which is driven in reciprocating motion by a rocker arm 67 driven by a rod 68 which is slidable on a cam 69 keyed to a gear 70. The latter meshes with a complementary gear 71 keyed to the second shaft 29*a* of the transmission box 22. The rotation of the cam 69 therefore causes the slider 66 to move to and fro and, by means of the pin 65, cause the support 64, the belt 61 and the pulley 55 to slide to and fro along the splined shafts 63 and 54.

During the operation of the equipment, the operator or a suitable automatic manipulator places the tool 100, carrying two pieces of cloth T between which the pad I of wadding is interposed, on the disc-shaped support 64. The equipment then starts its operating cycle which provides for the reciprocating motion of the sewing machines 18, the synchronised reciprocating rotation of the disc-shaped support 64, and finally the sliding of the disc-shaped support to and fro along the splined shaft 63. The combination of these three movements enables the needles 18*a* of the sewing machines 18 to sew the pieces of cloth T and the pad with a zig-zag stitch along a predetermined outline which can be repeated exactly in successive cycles When the cycle is complete, the operator or the manipulator removes the tool 100 with the sewn shoulder pads and transports them to a subsequent station for transverse cutting which produces two separate shoulder pads.

The equipment according to the invention lends itself to many adjustments Amongst these, there is mentioned the amplitude of oscillation of the connecting rod 43, which is adjustable by the radial positioning of the pin 41 relative to the disc 40.

Moreover, the equipment may include only one sewing machine. In this case, the sewing machine may conveniently be fixed to the structure and the tool carrying the shoulder pad may be driven in reciprocating rectilinear motion.

I claim:

1. Equipment for the automatic sewing of shoulder pads for clothing comprising:

a support structure, a pair of sewing machines supported for sliding, reciprocating, linear motion on the structure, an oscillator device adapted for connection to a tool which clamps together two, facing, shaped pieces of cloth with an interposed pad for forming the shoulder pads, support means for supporting the oscillator device on the support structure for reciprocating rotation about an axis parallel to the sliding, reciprocating, linear motion of the sewing machines, means for driving the sewing machines in said reciprocating linear motion, and means associated with the oscillator device for causing the reciprocating rotation of the oscillator device in synchronism with the sliding, reciprocating, linear motion of the sewing machines in order to provide for the sewing together of the pieces of cloth and the pad along a predetermined outline.

2. Equipment according to claim 1, wherein said pair of sewing machines are slidable along a common line relative to the support structure and each have a substantially vertical needle.

3. Equipment according to claim 2, wherein said support means supports the oscillator device for sliding along a path parallel to the line along which the sewing machines slide, and means are provided for driving the oscillator device in sliding, reciprocating, linear motion in synchronism with the reciprocating rotation of said oscillator device.

4. Equipment according to claim 1, wherein the means for driving the sewing machines in sliding, reciprocating, linear motion comprise:

a rotatable disc having an annular cam-like portion, a lever articulated to the support structure and having an end connected to one of the sewing machines, and a control arm connected to said lever and engaging said cam-like portion to impart the sliding, reciprocating, linear motion to said one sewing machine upon rotation of said disc.

5. Equipment according to claim 2 wherein said pair of sewing machines are interconnected by a pair of rods which are articulated to the sewing machines and to opposite ends of a rotary element which is rotatable about an axis perpendicular to the line along which the sewing machines slide, a driving movement of said one sewing machine causing an opposite movement of the other sewing machine through the rods and the rotary member.

6. Equipment according to claim 1 wherein said tool comprises means for supporting a semi-finished product for making shoulder pads for articles of clothing, constituted by two pieces of cloth between which a padding material is interposed, wherein said tool further comprises an upper element and a lower element which are curved about a longitudinal axis so as to have a substantially circular cross-section, means for coupling and clamping said elements together with the interposition of the semi-finished product, the elements having respective circular apertures which are curved about a diametral axis and connecting means adapted to connect said tool to said oscillator device.

7. Equipment according to claim 6, wherein the lower element has a curved support bridge of convex outline which is disposed transversely across the aperture in the lower element and is adapted to impart a corresponding curvature to the semi-finished product clamped between the upper and lower elements.

* * * * *